US008596816B2

(12) United States Patent
Atkins

(10) Patent No.: US 8,596,816 B2
(45) Date of Patent: Dec. 3, 2013

(54) MULTI-DIE LED PACKAGE AND BACKLIGHT UNIT USING THE SAME

(75) Inventor: Robin Atkins, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 139 days.

(21) Appl. No.: 13/320,055

(22) PCT Filed: May 25, 2010

(86) PCT No.: PCT/US2010/036067

§ 371 (c)(1),
(2), (4) Date: Nov. 11, 2011

(87) PCT Pub. No.: WO2010/141269

PCT Pub. Date: Dec. 9, 2010

(65) Prior Publication Data

US 2012/0063121 A1 Mar. 15, 2012

Related U.S. Application Data

(60) Provisional application No. 61/183,274, filed on Jun. 2, 2009.

(51) Int. Cl.
*F21V 9/00* (2006.01)

(52) U.S. Cl.
USPC ..... 362/231; 362/227; 362/234; 362/249.02; 362/800; 362/276; 345/46; 345/82

(58) Field of Classification Search
USPC ..... 362/227, 231, 234, 235, 249.01, 362/249.02, 249.05, 249.12, 800, 97.3, 362/276; 345/46, 82
See application file for complete search history.

(56) References Cited

U.S. PATENT DOCUMENTS

| | | | |
|---|---|---|---|
| 5,397,867 | A | 3/1995 | Demeo |
| 5,639,158 | A | 6/1997 | Sato |
| 6,998,594 | B2 | 2/2006 | Gaines |
| 7,045,820 | B2 | 5/2006 | Hayashi |
| 7,141,779 | B1 | 11/2006 | Chew |
| 7,152,988 | B2 | 12/2006 | Hung |
| 7,370,979 | B2 | 5/2008 | Whitehead |
| 2006/0028156 | A1 | 2/2006 | Jungwirth |
| 2006/0262530 | A1 | 11/2006 | Sakai |
| 2007/0170449 | A1 | 7/2007 | Anandan |
| 2008/0077363 | A1 | 3/2008 | Abdulaev |
| 2008/0117630 | A1 | 5/2008 | Durvasula |
| 2008/0128717 | A1 | 6/2008 | Jang |
| 2010/0118057 | A1 | 5/2010 | Atkins |

FOREIGN PATENT DOCUMENTS

| | | |
|---|---|---|
| DE | 10239449 | 8/2003 |
| EP | 2017890 | 1/2009 |
| JP | 2008-282744 | 11/2008 |
| KR | 10-2009-0011451 | 2/2009 |
| WO | 03/010830 | 2/2003 |
| WO | 2007057822 | 5/2007 |
| WO | 2007/065244 | 6/2007 |
| WO | 2007079423 | 7/2007 |
| WO | 2008/092276 | 8/2008 |
| WO | 2008152922 | 12/2008 |

*Primary Examiner* — Stephen F Husar
*Assistant Examiner* — Meghan Dunwiddie

(57) ABSTRACT

A multi-die LED package comprises a diode that works as a light-emitting diode for emitting light and as a sensing diode for detecting at least one physical quantity. The multi-die LED package is able to provide desired luminance and color independent of aging, temperature or other effects.

16 Claims, 11 Drawing Sheets

MULTI-DIE LED PACKAGE AND BACKLIGHT UNIT USING THE SAME

CROSS-REFERENCE TO RELATED APPLICATIONS

This application claims priority to U.S. Provisional Patent Application No. 61/183,274 filed 2 Jun. 2009, hereby incorporated by reference in its entirety.

TECHNICAL FIELD

The present invention relates to semiconductor devices, and more particularly to a light emitting diode (LED) package containing multiple dies. It further relates to a backlight unit comprising such an LED package. Embodiments of the invention have application in backlit or edge-lit displays. The displays may be flat panel liquid crystal displays. The displays may be high dynamic range displays as well as displays of other types.

BACKGROUND

LEDs are used for illumination in a wide variety of applications. For example, arrays of LEDs may be used as backlights in computer displays, televisions and other displays, some of which may comprise a plurality of individually controllable LEDs as light sources.

LED packages that contain multiple diodes of same or different colors (also referred to as multi-die LED packages) have been developed and have the advantages of reduced volume and manufacturing costs. Multi-die LED packages may be used in backlights of the above mentioned displays to provide high-intensity light, for example.

One problem with using LEDs as light sources is that the amount of light emitted at a specific driving current level can vary significantly between individual LEDs. This variation can result from manufacturing process variations. Further, the amount of light that an individual LED will produce for any given driving current tends to slowly decrease in an unpredictable manner as the LED ages.

Another problem associated with some LEDs is that color temperature of the emitted light can vary between individual LEDs or shift from a designed-for value by various amounts. Such color temperature variation or shift is undesirable in many situations.

The above problems apply to diodes in a multi-die LED package as well. It is therefore desirable to provide a mechanism for correcting for the above problems in a multi-die LED package.

In addition, as display panel sizes and accordingly the backlight unit sizes continue to increase, there exists a need for backlight units that are reliable and cost-efficient to manufacture and repair. In particular, there is a need for backlight units having an integrated optical structure that comprises a plurality of modules.

SUMMARY OF THE INVENTION

The present invention is directed to a multi-die LED package and backlight units comprising such a multi-die LED package that meet these needs.

One aspect of the present invention provides an LED package that comprises at least one LED die which is electrically connected to a controller and is driven to emit light in response to a driving signal from the controller. The LED die is configured to detect at least one physical quantity and transmit a feedback signal representative of the at least one physical quantity to the controller for adjusting the driving signal based on the feedback signal.

In one embodiment, the LED die comprises a diode that works as a light-emitting diode for emitting light and as a sensing diode for detecting the physical quantity. A measuring circuit is configured to receive and measure a current induced by the diode in response to the detected physical quantity and to transmit the measured quantity as the feedback signal to the controller. A driving circuit is configured to provide to the diode a driving current in response to the driving signal.

In another embodiment, A switch is configured to selectively connect the diode to the measuring circuit in the detecting mode or to the driving circuit in the light-emitting mode based on a switch control signal from the controller.

Another aspect of the present invention provides a backlight unit that comprises a light source formed of a plurality of LED packages arranged in a two-dimensional matrix. At least one of the LED packages comprises at least one LED die which is electrically connected to a controller and is driven to emit light in response to a driving signal from the controller. The same or other LED die can be reconfigured electrically to detect at least one physical quantity and transmit a feedback signal representative of the at least one physical quantity to the controller for adjusting the driving signal based on the feedback signal.

In some embodiments, the LED die may comprise a diode that works as a light-emitting diode for emitting light and as a sensing diode for detecting the physical quantity. A measuring circuit is configured to receive and measure a current induced by the diode in response to the detected physical quantity and to transmit the measured quantity as the feedback signal to the controller. A driving circuit is configured to provide to the diode a driving current in response to the driving signal.

In some other embodiments, the LED die may comprise a diode that works as a light-emitting diode in a light-emitting mode or as a sensing diode in a detecting mode for detecting the physical quantity. A measuring circuit is configured to receive and measure a current induced by the diode in response to the detected physical quantity and to transmit the measured quantity as the feedback signal to the controller. A driving circuit is configured to provide to the diode a driving current in response to the driving signal. A switch is configured to selectively connect the diode to the measuring circuit in the detecting mode or to the driving circuit in the light-emitting mode based on a switch control signal from the controller.

It is to be understood that both the foregoing general description and the following detailed description are exemplary and are intended to provide further explanation of the invention claimed.

BRIEF DESCRIPTION OF THE DRAWINGS

The accompanying drawings are included to illustrate and provide a further understanding of the invention. Together with the description, these drawings serve to explain the principles of the invention. In the drawings.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
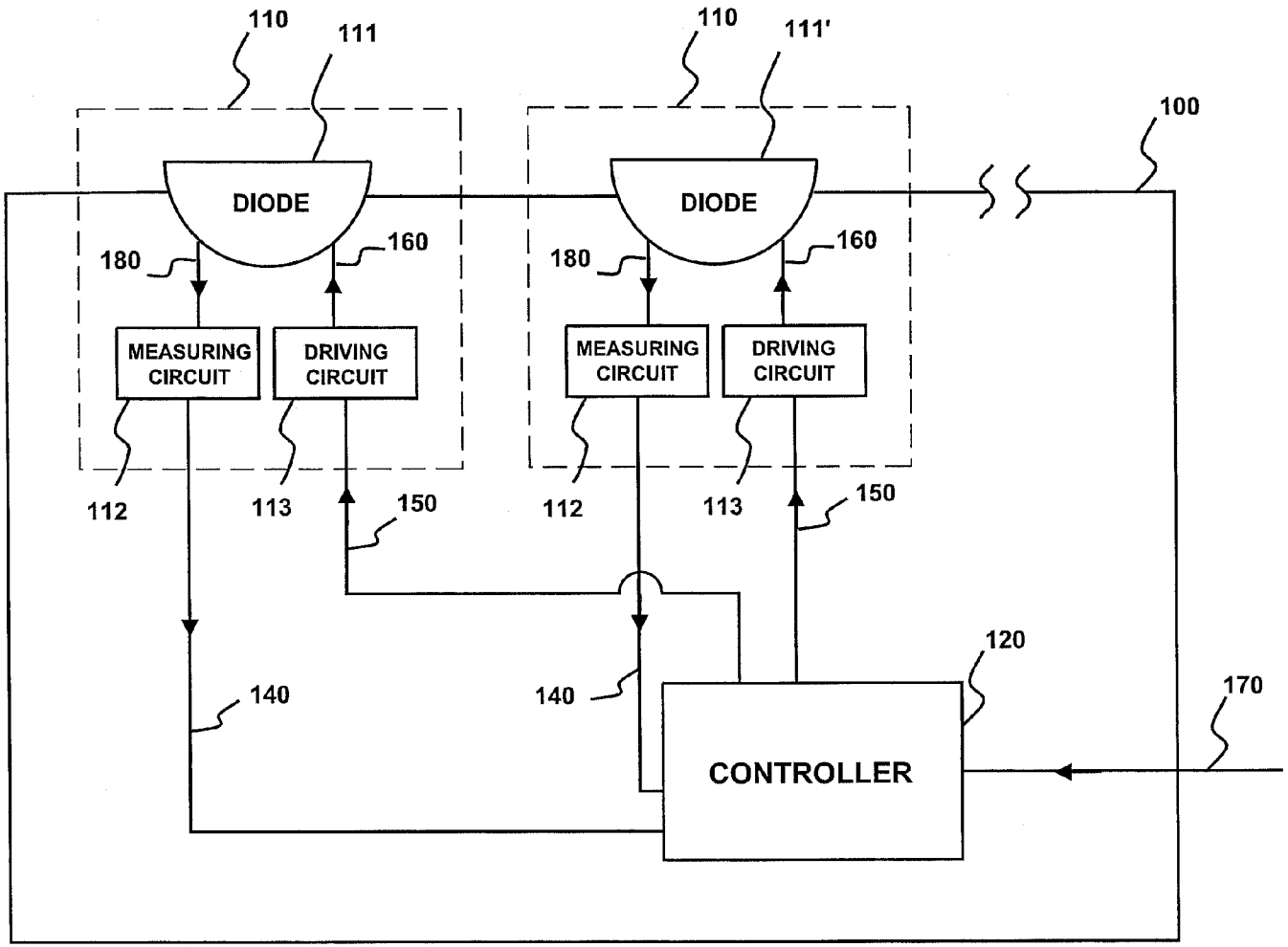
FIG. 1 is a block diagram of a multi-die LED package in accordance with one embodiment of the invention.

Referring now to the drawings, wherein like reference numerals designate identical or corresponding parts, and more particularly to FIG. 1 thereof, there is illustrated an LED package 100 according to one embodiment of the invention. In the illustrated embodiment, LED package 100 comprises a plurality of LED dies 110. Light output of each LED die 110 may be controlled individually by controller 120. LED die 110 comprises a diode 111 which is electrically connected to a measuring circuit 112 and a driving circuit 113. Diode 111 may work as a light sensing diode such as a photodiode in a light sensing mode, or may work as a light emitting diode in a light emitting mode.

In the light emitting mode, in response to a driving signal 150 received from controller 120, driving circuit 113 provides a driving current 160 to diode 111 to cause diode 111 to emit light of a desired intensity and/or spectral characteristics. Controller 120 may receive an input signal 170 such as an image signal from an input device (not shown in the figure). The desired intensity and/or spectral characteristics may be specified in input signal 170.

In the light sensing mode, diode 111 works as a light sensing diode to detect light emitted by at least one other diode in LED package 100, for example light emitting diode 111' in FIG. 1. Light incident on diode 111 generates induced current 180 and the induced current is received and measured by measuring circuit 112 which may comprise a current detector. Measuring circuit 112 then transmits a feedback signal 140 to controller 120. Feedback signal 140 may indicate the intensity of light emitted by the at least one other diode 111'. Measuring circuit 112 may additionally or alternatively comprise a spectrometer, in which case the feedback signal 140 may indicate the spectral characteristics of light emitted by the at least one other diode 111'. Controller 120 may determine the light output of the at least one other diode 111' based on feedback signal 140, adjust driving signal 150 in accordance with the desired intensity and/or spectral characteristics specified in input signal 170, and transmit the adjusted driving signal to driving circuit 113 of light emitting diode 111'. In response to the adjusted driving signal, driving circuit 113 of diode 111' provides a driving current to diode 111' to cause diode 111' to emit light of a desired intensity and/or spectral characteristics as specified in input signal 170.

Figure 2:
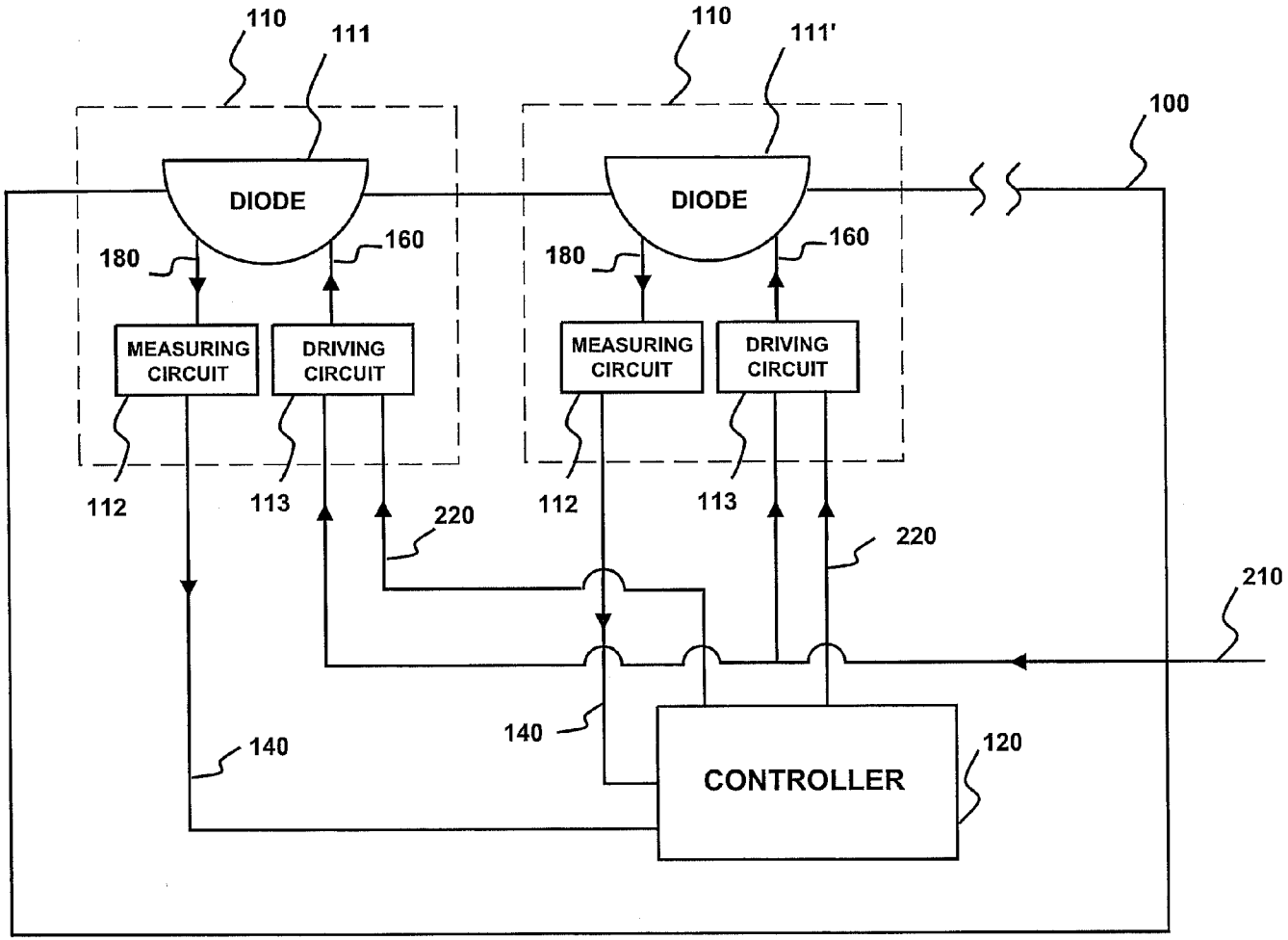
FIG. 2 is a block diagram of a multi-die LED package in accordance with another embodiment of the invention.

In an alternative embodiment as shown in FIG. 2, driving circuit 113 may receive a driving signal 210 directly from the input or control device (not shown in the figure). Controller 120 may generate an adjustment signal 220 based on the feedback signal 140. Driving circuit 113 adjusts the driving signal 190 in accordance with the adjustment signal 220 and provides a driving current to diode 111' to cause diode 111' to emit light of a desired intensity and/or spectral characteristics.

In the above embodiments, controller 120 is integrated in an LED package 100, as shown in FIGS. 1 and 2. Alternatively, controller 120 may also be provided outside LED package 100, being electrically connected to one LED package or a plurality of LED packages.

Figure 3:
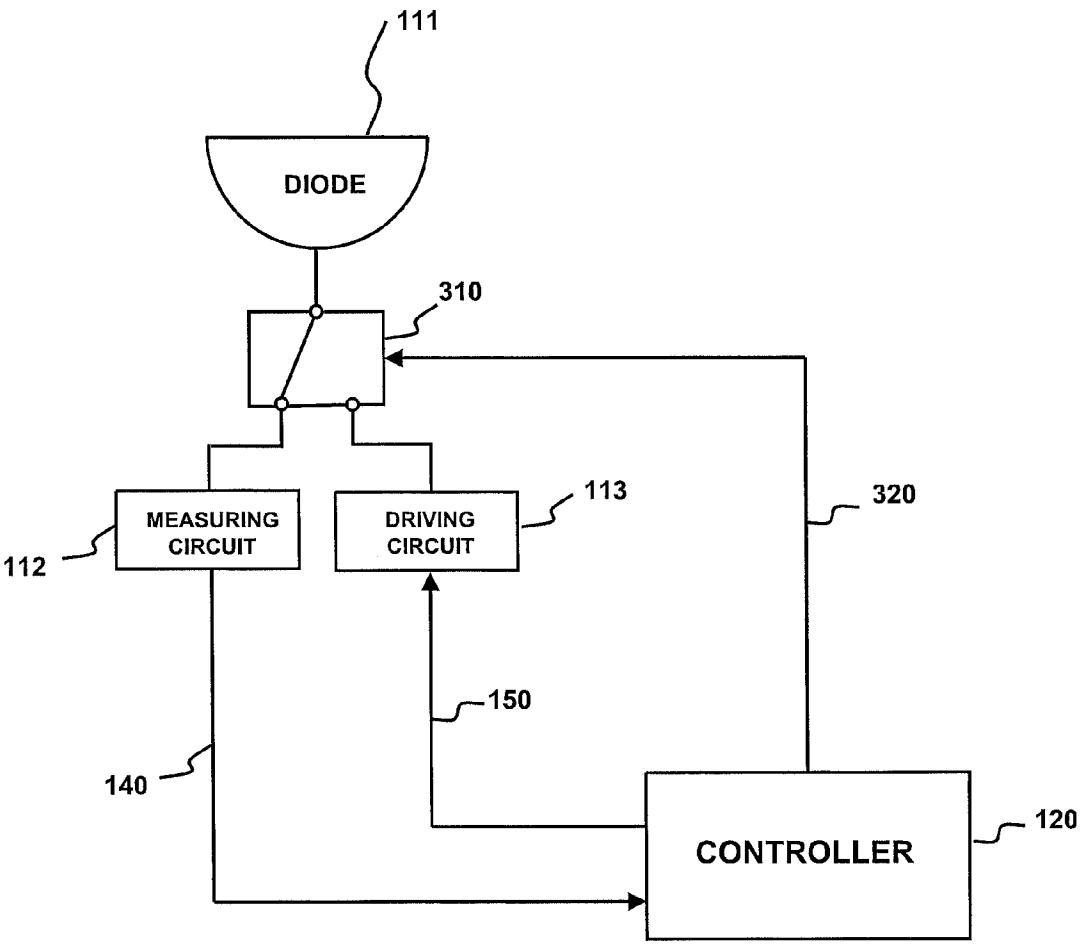
FIG. 3 is a block diagram of an example circuit for selectively causing a diode to emit light or detect a physical quantity.

FIG. 3 shows an embodiment wherein a switch 114 is provided for selectively connecting diode 111 to a driving circuit 113 or a measuring circuit 112. Switch 114 may be operated between a driving position and a measuring position by controller 120 by means of a switch control line 310. When switch 114 is in the driving position, diode 111 is in the light emitting mode and works as a light emitting diode, as described in the above embodiments illustrated in FIG. 1 and FIG. 2. When switch 114 is in the measuring position, diode 111 is in the light sensing mode and works as a light sensing diode, as described in the above embodiments illustrated in FIG. 1 and FIG. 2.

In another embodiment, diode 111 may also alternatively or additionally work as a temperature sensing diode in the light emitting mode or light sensing mode. As shown in FIGS. 1 to 3, for example, a forward-bias may be provided to diode 111 and the variations in voltage across the diode junction may be measured by measuring circuit 112 as an indication of detected temperature of diode 111 or its surroundings. Feedback signal representative of the detected temperature is transmitted to controller 120. Controller 120 may determine the light output of diode 111 based on feedback signal 140, adjust driving signal 150 and transmit the adjusted driving signal to driving circuit 113 of light emitting diode 111. In response to the adjusted driving signal, driving circuit 113 of diode 111 provides a driving current to cause diode 111 to emit light of a desired intensity and/or spectral characteristics.

In some embodiments, an LED package 100, as shown in FIGS. 1 and 2, may incorporate multiple individually-controlled LED dies 110 which are used to cross-calibrate each other for constant luminance and color output.

Figure 4:
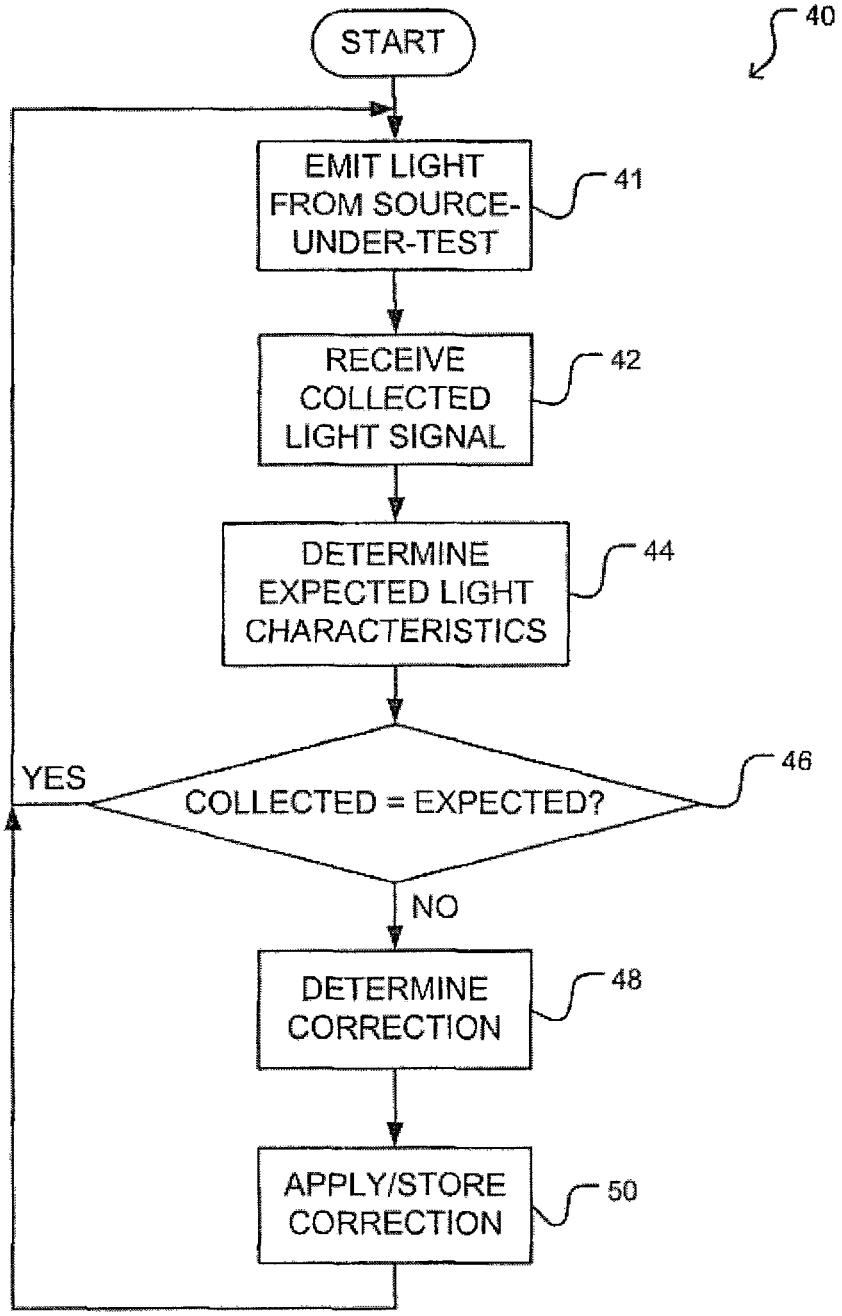
FIG. 4 is a flow diagram showing steps of calibrating a multi-die LED package according to one embodiment of the invention.

FIG. 4 is a flowchart illustrating a method 400 for calibrating an LED package according to one embodiment of this invention. At block 410, the controller causes one of the diodes, which is referred to herein as a source-under-test, to emit light. The source-under-test may emit light in response to a calibrating driving signal.

The controller may cause only the source-under-test to emit light. In such situations the emitted light may be detected by neighboring light sensing diodes upon which the emitted light is incident. The brief loss of light of all other diodes which are in the light sensing mode would be too short to be noticeable as a flicker.

At block 420, the controller receives a feedback signal representative of the detected light. The feedback signal may comprise one or more signals received from one or more light sensing diodes. The feedback signal may indicate the intensity and/or color temperature of light emitted from the source-under-test. In some embodiments, the feedback signal also indicates the temperature of the source-under-test. The feedback signal may represent light and/or temperature detected during a calibration cycle wherein the source-under-test is provided with a calibrating driving signal.

At block 440, the controller determines expected light characteristics for the detected light or temperature represented by the feedback signal. Determining the expected light characteristics may comprise, for example, looking up stored reference values for the source-under-test. The expected light characteristics may comprise, for example, intensity levels and/or spectral characteristics expected for given driving signals. The reference values may be stored, for example, in a memory accessible by the controller. The memory, for example, may be incorporated in the controller.

At block 460 the controller compares the feedback signal with the expected light characteristics. If the feedback signal indicates that the light emitted by the source-under-test has the expected characteristics (block 460 YES output), then no correction is required. Method 400 may then return to block 410 in order to calibrate another diode in the LED package, or may end if all diodes in the LED package been calibrated.

If the feedback signal indicates that the light emitted by the source-under-test does not have the expected characteristics (block 460 NO output), then a correction may be required. Method 400 then proceeds to block 480.

At block 480, the controller determines a correction to be applied based on the results of the comparison of block 460. For example, if the comparison indicates that the intensity of the light emitted by the source-under-test is different from the expected intensity, the controller may determine an intensity correction for the source-under-test and store the intensity correction in a data structure located in a memory accessible by the controller. Likewise, if the comparison indicates that the color temperature of the source-under-test differs from the expected color temperature, the controller may determine a color correction for the source-under-test and store the color correction in a data structure located in a memory accessible by the controller.

If the comparison indicates that the intensity of the light emitted by the source-under-test is less than the expected intensity, the intensity correction may comprise, for example, an indication to adjust the driving signal such that an increased driving current is provided to the source-under-test. Alternatively or additionally, the intensity correction may comprise an indication to adjust the driving signal such that an increased voltage is provided to the source-under-test.

In the embodiments described above, multiple diodes 111 in LED package 100 may comprise diodes of a same color, for example white diodes. Alternatively, multiple diodes 111 may comprise diodes of different colors, for example red, green and blue diodes. In such embodiments, driving signals 150 may cause driving circuit 113 to separately control the brightness of diodes 111 of different colors and, within a particular color, to separately control the brightness of diodes 111 in different locations.

In some embodiments, multiple diodes 111 in LED package 100 may be selected to differ (e.g., differ slightly) in color temperature to allow controller 120 to maintain constant color temperature as well as luminous flux of the LED package 100. For example, to generate a light output that has a desired color temperature, a multi-die LED package may comprise one or more first diodes which are selected to have a first color temperature slightly greater than the desired color temperature, and one or more second diodes which are selected to have a second color temperature slightly less than the desired color temperature. By driving the one or more first diodes and second diodes and combining their light outputs, a light output that has a desired color temperature may be obtained. In such LED packages, the effect of color temperature shift (caused by LED aging, for example) may be minimized and compensated.

The multi-die LED package described in the above embodiments may further comprise a light diffusion layer disposed in front of the diodes for uniformly distributing the light emitted from the diodes. The diffusion layer may be made from a highly diffusing but non-absorbing material. The light diffusion layer may comprise a non-uniform pattern of dot elements of varying density for further increasing illumination uniformity.

Figure 5:
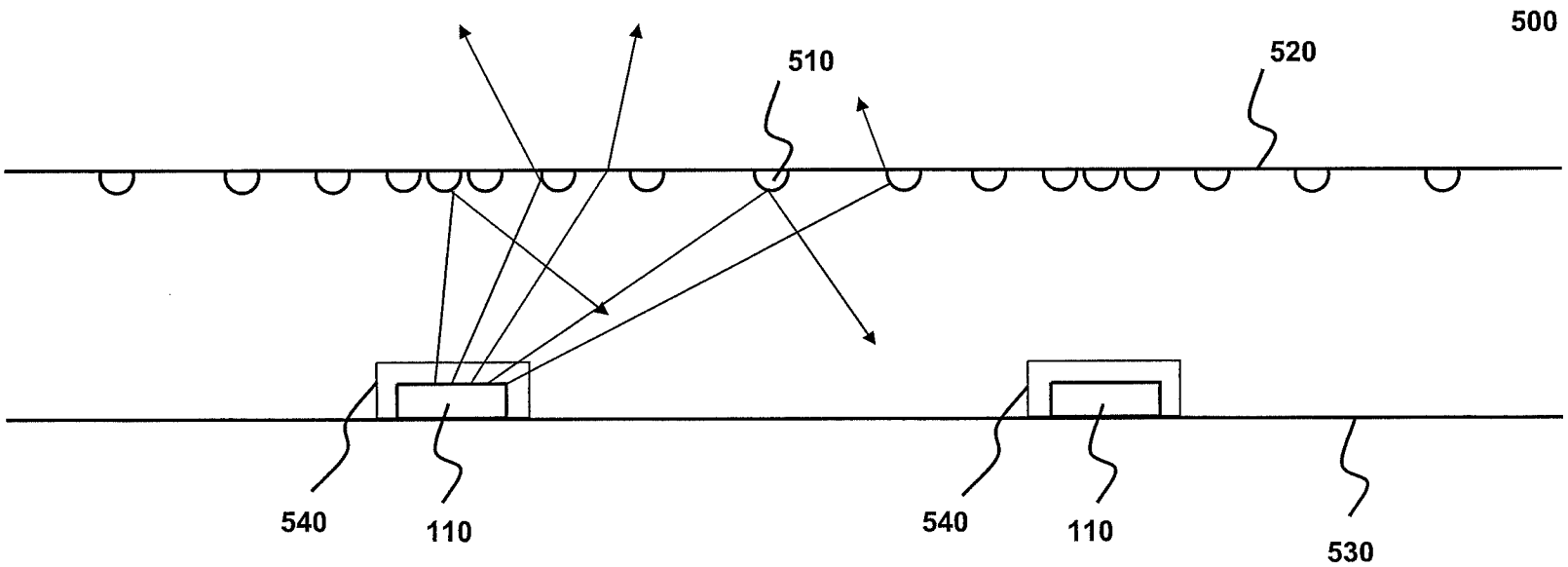
FIG. 5 is a cross-section view of a light diffusion layer with non-uniform pattern of dot elements in accordance with one embodiment of the invention.

FIG. 5 shows a cross-section of a light diffusion layer 500 according to one embodiment of the invention. In FIG. 5, reflective dot elements 510 are embedded within the front surface 520 of diffusion layer 500 and are arranged in a non-uniform pattern that has a maximum dot density at its central area. The center area of the pattern is axially aligned with an LED die 110. The density gradually decreases as the distance from the central area increases. The higher density of reflective dots at the central area reduces the maximum intensity of light near the LED die and spreads light to neighboring areas. Such a non-uniform pattern of reflective dot elements ensures uniform light spread across light diffusion layer 500.

Figure 6:
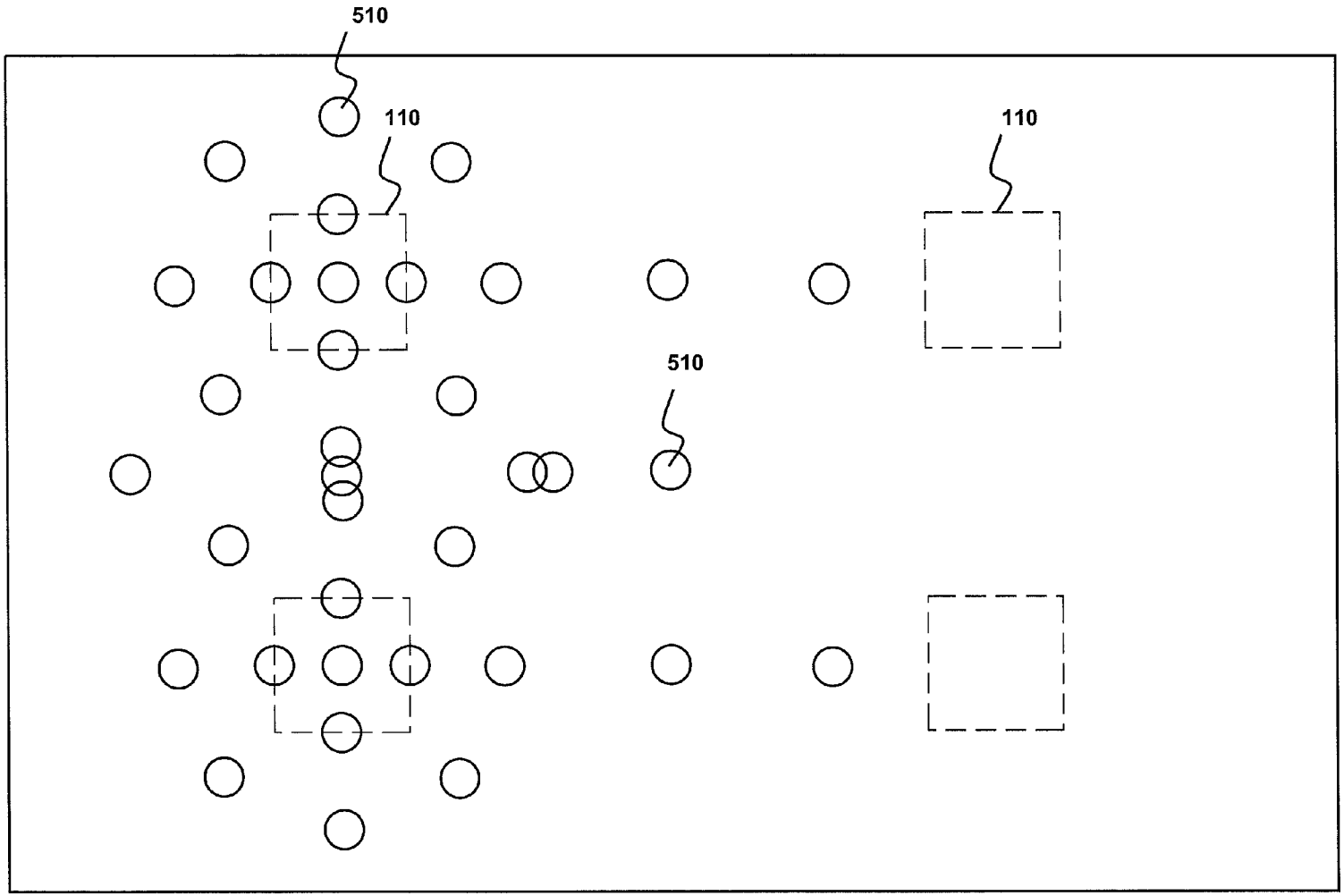
FIG. 6 is a top view of the light diffusion layer as shown in FIG. 5.

FIG. 6 shows a top view of the light diffusion layer as illustrated in FIG. 5, which has four LED dies provided behind the two-dimensional non-uniform pattern of the dot elements.

Variations may be made to the embodiments as illustrated above. For example, while dot elements 510 are shown as hemispheres in FIGS. 5 and 6, they may be of other three-dimensional shapes in alternative embodiments, including, for example, any of a sphere, cube, cylinder, cone, and the like or combinations thereof. Dot elements may be of two-dimensional shapes as well, such as ovals, ellipses, and various shaped polygons, or combinations thereof. A dot element may be solid or a void such as a dimple. Dot elements may be fully or partially embedded in the diffusion layer, or may be provided on the front surface of the diffusion, for example as painted dots. Dot elements or peripheries of voids may be made of absorptive or reflective materials. While serving to minimize the thickness of the diffusion layer by pressing the LED dies inside pockets 540 which are cutout cavities within light diffusion layer 500 as shown in FIG. 5, these LED pockets are optional and the LED dies may be immediately or closely behind the rear surface 530 of light diffusion layer 500.

In addition, while dot elements 510 are of same size as shown in FIGS. 5 and 6, it is understood that they may be of varying size in alternative embodiments. For example, the size of dot elements 510 may gradually decrease as the distance from the central area increases. The bigger size of reflective dots at the central area reduces the maximum intensity of light near LED die 110 and spreads light to neighboring areas.

Multi-die LED packages described in the above embodiments may be used as a light source in a backlight unit. For example, a backlight unit may comprise a light source that has a plurality of such LED packages arranged in a two-dimension matrix form. The backlight unit may further comprise a light diffusion layer disposed in front of the light source for producing uniform distribution of light emitted from the light source. The diffusion layer may be made from a highly diffusing but non-absorbing material, and may comprise a non-uniform pattern of dot elements of varying density for further increasing illumination uniformity, similar to dot elements 510 shown in FIGS. 5 and 6.

According to one embodiment of this invention, the light diffusion layer comprises a plurality of dot elements arranged in a pattern that has a maximum dot density close to the central area of the pattern. The density gradually decreases as the distance from the central area increases. The center area of the pattern is axially aligned with an LED die in an LED package. In another embodiment, the center area of the pattern is axially aligned with at least one of a plurality of the LED packages.

Figure 7:
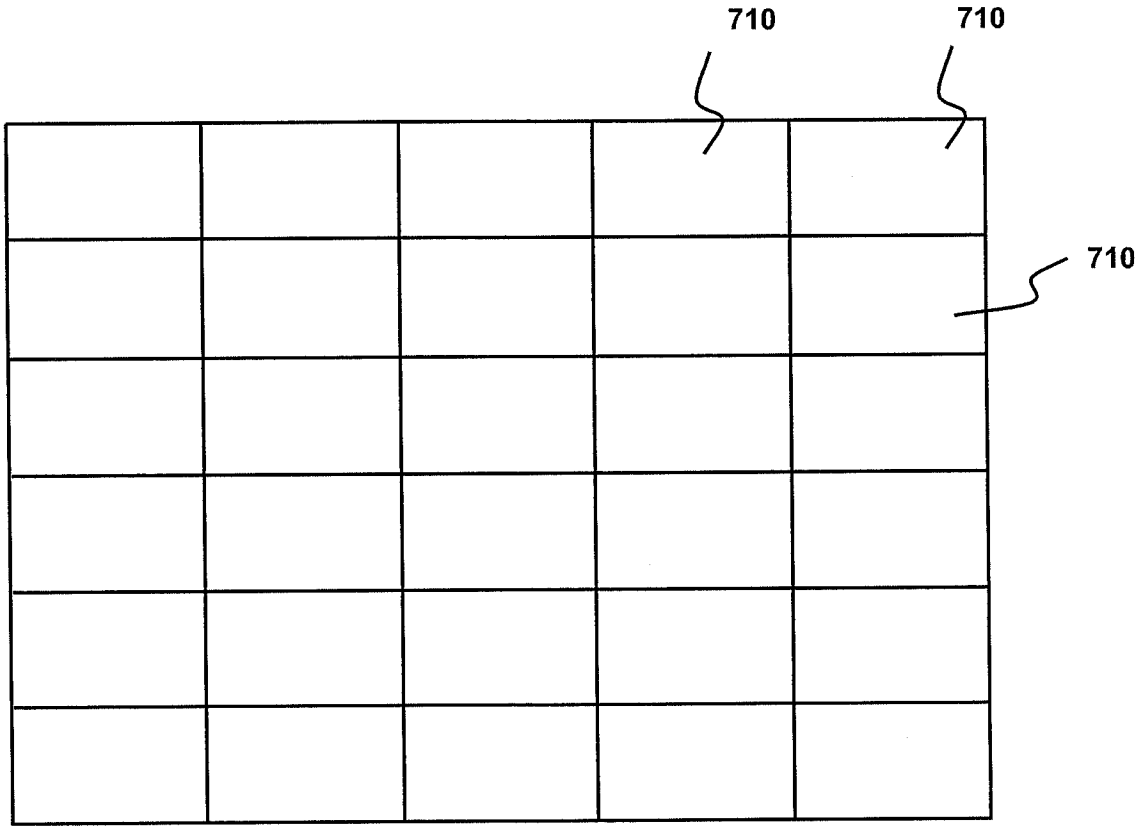
FIG. 7 is a schematic view of a light diffusion layer comprising a plurality of rectangular optical modules according to one embodiment of the invention.

The light diffusion layer may be designed to comprise a plurality of two-dimensional optical modules arranged laterally, as shown in FIG. 7. Each of optical modules 710 has at least one optical connector disposed on the periphery for optically coupling to other optical modules. Optical modules 710 can be combined to provide a light diffusion layer of larger size. The optical modules are each rectangular in shape and provide uniform illumination across the surface and across module boundaries. Alternatively, the modules may be of other shapes that can be optically coupled, such as a square or a triangle. Each module is illuminated with one or more LED packages, either directly behind the module, embedded within the module, or along the edge of a module.

Figure 8:
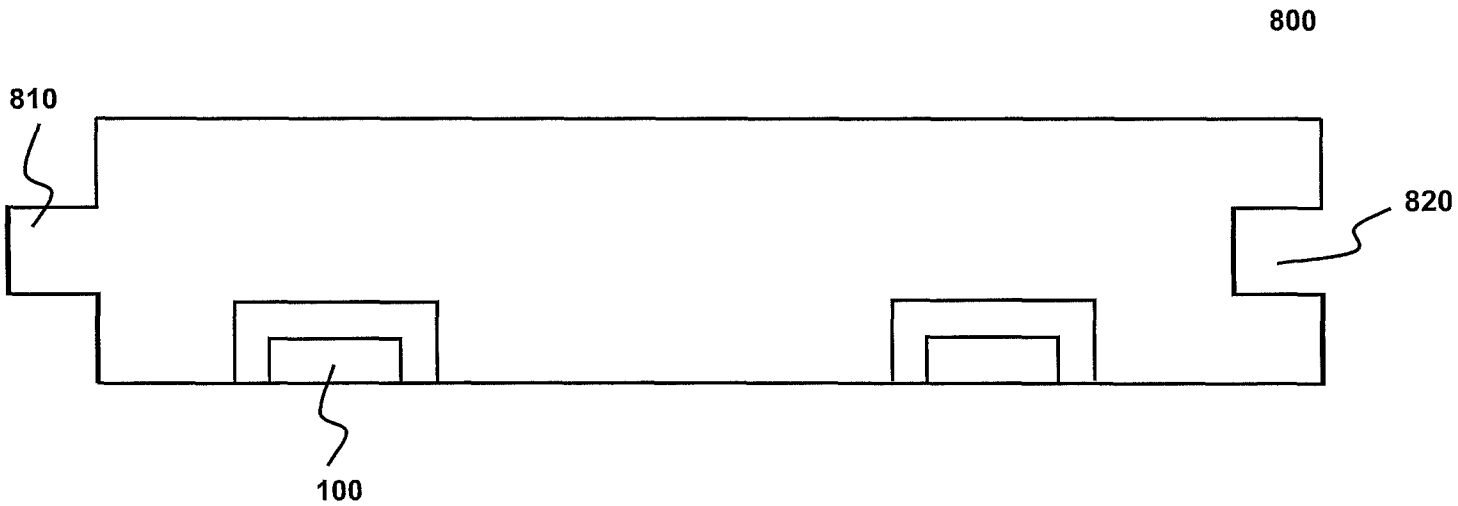
FIG. 8 is a cross-section view of a light diffusion module with tongue and groove interlocking structure in accordance with one embodiment of the invention.
Figure 9:
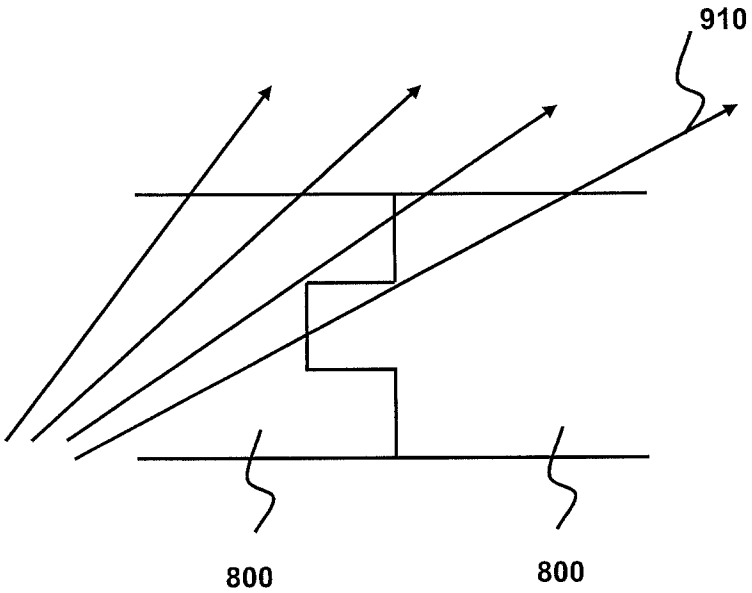
FIG. 9 is a side view showing light crossing a module boundary in accordance with one embodiment of the invention.

FIG. 8 shows a cross-section view of an optical module 800 with tongue 810 and groove 820 interlocking structure in accordance with one embodiment of the invention. The two-dimensional tongue and groove design ensures even illumination across the boundary between two optical modules. FIG. 9 shows light 910 crossing the module boundary with the tongue and groove design. An optical coupling fluid or gel, for example, may be used to reduce internal refractions due to air pockets.

Figure 10:
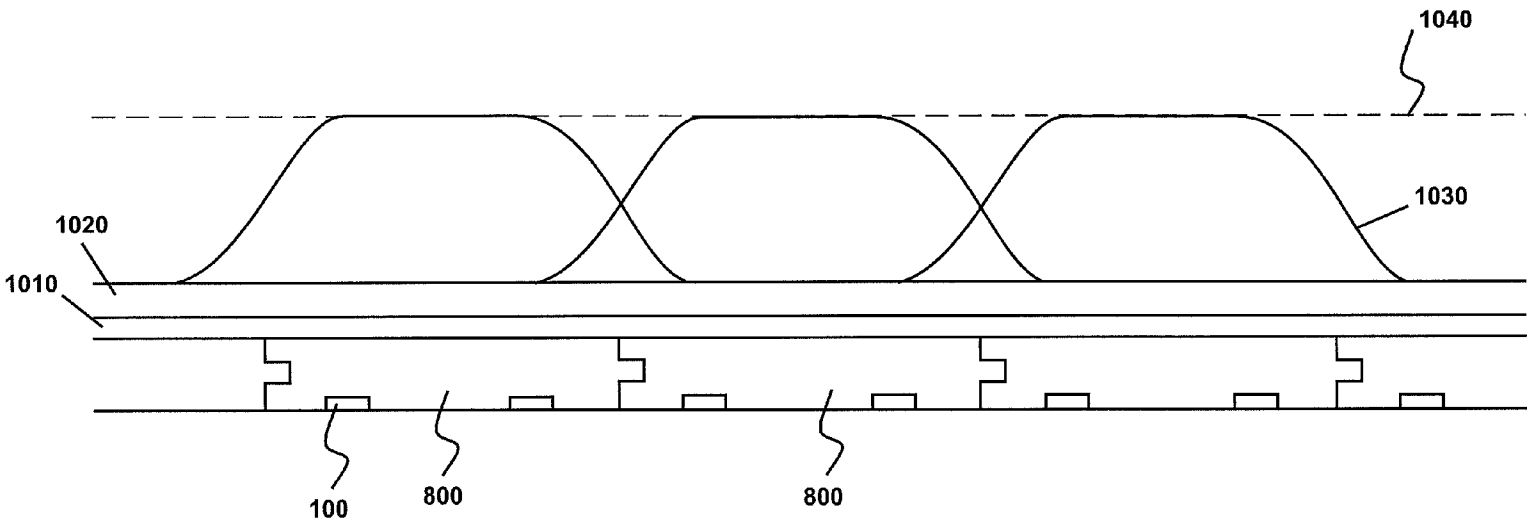
FIG. 10 is a schematic view of a liquid crystal display with a backlight unit comprising tiled optical modules according to one embodiment of the invention.

FIG. 10 is a schematic view of a liquid crystal display that has a backlight unit comprising tiled optical modules 800 according to one embodiment of the invention. Optionally there may be a slight air gap 1010 between tiled optical modules 800 and LCD 1020 panel to assist with ensuring uniformity. In FIG. 10, the light field 1030 from each optical module 800 overlaps and sums to create a uniform light field 1040 when all optical modules 800 are fully on. In some embodiments, calibration may be performed to eliminate or minimize differences in optical intensity between modules.

Figure 11:
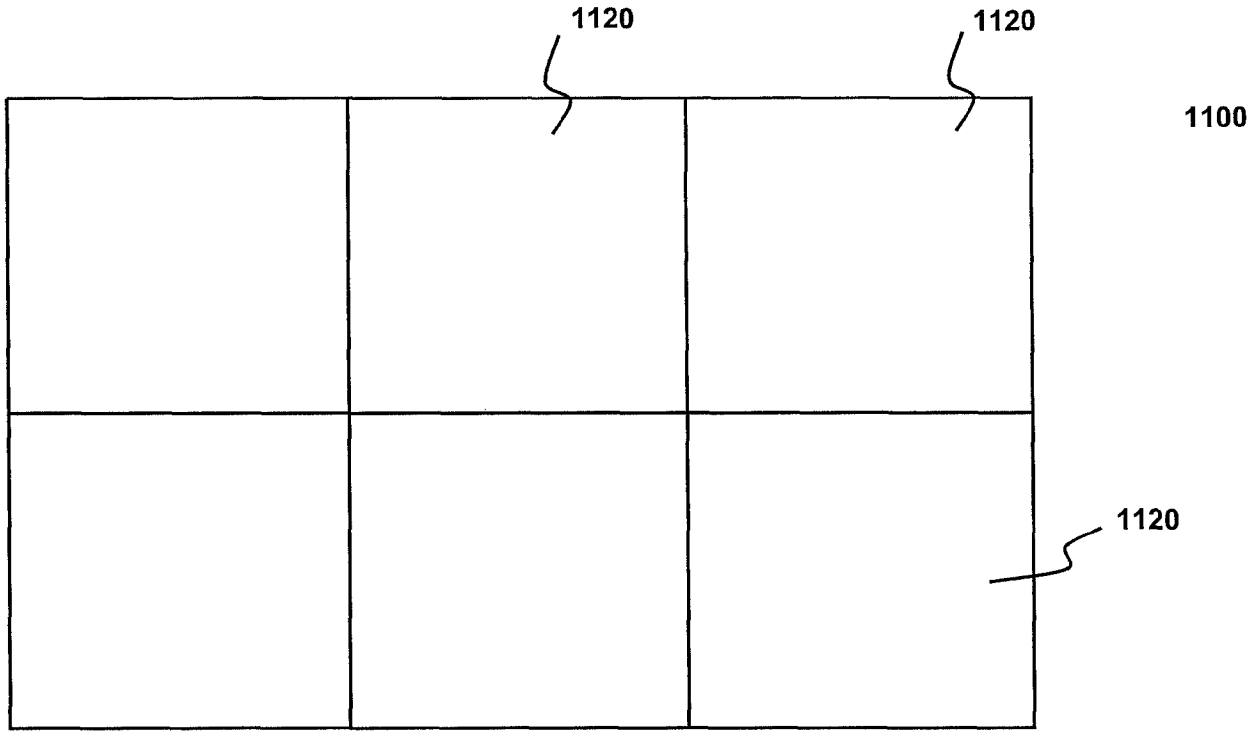
FIG. 11 is a schematic view of a backlight unit comprising backlight modules according to one embodiment of the invention

FIG. 11 is a schematic view of a backlight unit 1100 that comprises a plurality of two-dimensional backlight modules 1120 according to one embodiment of the invention. All backlight modules 1120 can be tiled laterally to form a complete modulated backlight unit 1100. Each backlight module 1120 may comprise one or more multi-die LED packages described above. Each backlight module may be individually controlled by drive electronics, and may further have self-contained drive electronics, or may be part of a larger electrical design. Each backlight module 1120 may comprise of one or more optical modules that form a light diffusion layer in front of the LED packages incorporated in backlight module 1120.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents which operate in a similar manner. For example, when describing a light source, such as an LED, any other equivalent device, such as OLEDs, fluorescent or incandescent lighting, nanotube based light sources, or other devices having an equivalent function or capability, whether or not listed herein, may be substituted therewith. Furthermore, the inventors recognize that newly developed technologies not now known may also be substituted for the described parts and still not depart from the scope of the present invention. All other described items, including, but not limited to, LEDs, optical couplers, diffusers, array structures, display structures, controllers, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/–, micro-drive, and magneto-optical disks, ROMs, RAMs, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications. Ultimately, such computer readable media further includes software for performing the present invention, as described above.

Included in the programming (software) of the general/specialized computer or microprocessor are software modules for implementing the teachings of the present invention, including, but not limited to, detecting of color temperatures and/or intensities, adjusting drive signals of light sources, calculating drive levels of light sources having differing color temperatures to produce a combined and desired output light temperature, and the display, storage, or communication of results according to the processes of the present invention.

The present invention may suitably comprise, consist of, or consist essentially of, any of element (the various parts or features of the invention and their equivalents as described herein, currently existing, and/or as subsequently developed. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

Accordingly, the invention may be embodied in any of the forms described herein, including, but not limited to the following Enumerated Example Embodiments (EEEs) which describe structure, features, and functionality of some portions of the present invention:

EEE1. An LED package comprising at least one LED die, the at least one LED die being configured to be electrically connected to a controller and to be driven to emit light in response to a driving signal from the controller, wherein the at least one LED die is further configured to detect at least one physical quantity, and transmit a feedback signal representative of the at least one physical quantity to the controller to adjust the driving signal based on the feedback signal.

EEE2. The LED package of EEE1, wherein the at least one LED die comprises:

a diode, the diode being a light-emitting diode for emitting light and a sensing diode for detecting the physical quantity;

a measuring circuit configured to receive and measure a current induced by the diode in response to the detected physical quantity and transmit the measured quantity as the feedback signal to the controller; and a driving circuit configured to provide to the diode a driving current in response to the driving signal.

EEE3. The LED package of EEE1, wherein the at least one LED die comprises:

a diode, the diode being a light-emitting diode in a light-emitting mode or a sensing diode in a detecting mode for detecting the physical quantity;

a measuring circuit configured to receive and measure a current induced by the diode in response to the detected physical quantity and transmit the measured quantity as the feedback signal to the controller;

a driving circuit configured to provide to the diode a driving current in response to the driving signal; and a switch configured to selectively connect the diode to the measuring circuit in the detecting mode or to the driving circuit in the light-emitting mode based on a switch control signal from the controller.

EEE4. The LED package of EEE3, wherein the controller is integrated in the LED package.

EEE5. The LED package of EEE4, wherein the LED package comprises at least a first LED die emitting red light, a second LED die emitting green light, and a third LED die emitting blue light.

EEE6. The LED package of EEE4, wherein the LED package comprises two or more LED dies which emit essentially a same color.

EEE7. The LED package of EEE6, wherein the same color is white color.

EEE8. The LED package of EEE4, wherein the LED package comprises two or more LED dies which differ in color temperature.

EEE9. The LED package of EEE4, further comprising a light diffusion layer disposed in front of the at least one LED die for uniformly distributing the emitted light, wherein the light diffusion layer comprises a plurality of dot elements arranged in a pattern that has a maximum dot density adjacent a central area of the pattern with the density gradually decreasing as a function of distance from the central area, the center area of the pattern being axially aligned with the at least one LED die.

EEE10. The LED package of any of EEE1 to EEE9, wherein the physical quantity comprises operating temperature of the at least one LED die, and the feedback signal comprises a representation of the operating temperature.

EEE11. The LED package of any of EEE1 to EEE9, wherein the physical quantity comprises at least a portion of light emitted by at least one other die in the LED package, and the feedback signal comprises a representation of an intensity of the detected light.

EEE12. The LED package of any of EEE1 to EEE9, wherein the physical quantity comprises at least a portion of light emitted by at least one other die in the LED package, and the feedback signal comprises a representation of a color temperature of the detected light.

EEE13. A backlight unit comprising a light source having a plurality of LED packages arranged in a two-dimension matrix form, wherein at least one of the plurality of LED packages comprises at least one LED die which is configured to be electrically connected to a controller and to be driven to emit light in response to a driving signal from the controller, wherein the at least one LED die is configured to detect at least one physical quantity and transmit a feedback signal representative of the at least one physical quantity to the controller for adjusting the driving signal based on the feedback signal.

EEE14. The backlight unit of EEE13, wherein the at least one LED die comprises:

a diode, the diode being a light-emitting diode for emitting light and a sensing diode for detecting the physical quantity;

a measuring circuit configured to receive and measure a current induced by the diode in response to the detected physical quantity and transmit the measured quantity as the feedback signal to the controller; and a driving circuit configured to provide to the diode a driving current in response to the driving signal.

EEE15. The backlight unit of EEE13, wherein the at least one LED die comprises:

a diode, the diode being a light-emitting diode in a light-emitting mode or a sensing diode in a detecting mode for detecting the physical quantity;

a measuring circuit configured to receive and measure a current induced by the diode in response to the detected physical quantity and transmit the measured quantity as the feedback signal to the controller;

a driving circuit configured to provide to the diode a driving current in response to the driving signal; and a switch configured to selectively connect the diode to the measuring circuit in the detecting mode or to the driving circuit in the light-emitting mode based on a switch control signal from the controller.

EEE16. The backlight unit of EEE15, wherein the controller is integrated in the LED package.

EEE17. The backlight unit of EEE16, wherein the LED package comprise at least a first LED die emitting red light, a second LED die emitting green light, and a third LED die emitting blue light.

EEE18. The backlight unit of EEE16, wherein the LED package comprises two or more LED dies which emit essentially a same color.

EEE19. The backlight unit of EEE18, wherein the same color is white color.

EEE20. The backlight unit of EEE16, wherein the LED package comprises two or more LED dies which differ in color temperature.

EEE21. The backlight unit of EEE16, further comprising a light diffusion layer disposed in front of the at least one LED die for uniformly distributing the emitted light, wherein the light diffusion layer comprises a plurality of dot elements arranged in a pattern that has a maximum dot density adjacent a central area of the pattern with the density gradually decreasing as a function of distance from the central area, the center area of the pattern being axially aligned with the at least one LED die.

EEE22. The backlight unit of any of EEE13 to 21, wherein the physical quantity comprises operating temperature of the at least one LED die, and the feedback signal represents the operating temperature.

EEE23. The backlight unit of any of EEE13 to 21, wherein the physical quantity comprises at least a portion of light emitted by at least one other die in the LED package, and the feedback signal represents intensity of the detected light.

EEE24. The backlight unit of any of EEE13 to 21, wherein the physical quantity comprises at least a portion of light emitted by at least one other die in the LED package, and the feedback signal represents color temperature of the detected light.

EEE25. A backlight unit of any of EEE13 to 21, further comprising a light diffusion layer disposed in front of the light source for producing uniform distribution of light emitted from the light source.

EEE26. A backlight unit of EEE25, wherein the light diffusion layer comprises a plurality of dot elements arranged in a pattern that has a maximum dot density adjacent a central area of the pattern with the density gradually decreasing as a function of distance from the central area, the center area of the pattern being axially aligned with at least one of the plurality of LED packages.

EEE27. A backlight unit of EEE26, wherein the light diffusion layer comprises a plurality of diffusion modules arranged laterally, each having at least one optical connector disposed on the periphery for optically coupling the diffusion module to at least one other diffusion module.

EEE28. A backlight unit of EEE27, wherein the optical connector has an interlocking structure comprising at least a tongue and a groove.

EEE29. A backlight unit of EEE13, wherein the light source comprises a plurality of backlight modules each comprising:

at least one of the plurality of LED packages; and a light diffusion layer disposed in front of the at least one of the plurality of LED packages, the light diffusion layer comprising a plurality of dot elements arranged in a pattern that has a maximum dot density adjacent a central area of the pattern with the density gradually decreasing as a function of distance from the central area, the center area of the pattern being axially aligned with the at least one of the plurality of LED packages.

EEE30. A method of driving a display backlight, comprising the steps of:

driving a first light source having a first color temperature with a first driving signal; and driving a second light source having a second color temperature with a second driving signal such that a color temperature of light emitted by the first light source combined with a color temperature of light emitted by the second light source produce a resultant light having a desired color temperature; and wherein the first color temperature and the second color temperature differ by an amount such that after aging of the light sources, the driving signals can be adjusted such the resultant light maintains the desired color temperature.

EEE31. The method according to EEE30, further comprising the step of adjusting the first and second driving signals to maintain the desired color temperature.

EEE32. A method, comprising the steps of driving multiple light sources comprising lights of at least two different color temperatures in a manner that produces an output light of a desired color temperature.

EEE33. The method according to EEE32, wherein the lights of at least two different color temperatures comprise different color temperatures of a same color.

EEE34. The method according to EEE32, wherein the step of driving is adjusted such that the output light remains at the desired color temperature despite changes in the color temperatures of the light sources.

EEE35. The method according to EEE32, wherein the step of driving is adjusted such that the output light remains at the desired color temperature as the light sources age EEE36. The method according to EEE32, wherein the desired color temperature varies according to environmental factors.

EEE37. The method according to EEE36, wherein the environmental factors comprises ambient lighting.

EEE38. The method according to EEE32, wherein the different color temperatures are selected such that the desired color temperature can be maintained despite aging of the light sources.

EEE39. A lighting package, comprising:

multiple light sources comprising at least two different color temperatures;

a controller configured to drive the light sources in a manner that produces an output light of a desired color temperature;

wherein the at least two different color temperatures vary in temperature by an amount that allows production of the output light of the desired temperature despite at least one varying factor.

EEE40. The lighting package according to EEE39, wherein the at least one varying factor comprises aging of the light sources.

EEE41. The lighting package according to EEE39, further comprising a detector connected to the controller, wherein the controller is further configured to adjust the light sources in a manner that maintains the desired color temperature of the output light through aging and/or other changes of the light sources.

EEE42. The lighting package according to EEE39, wherein the light sources comprise LEDs.

EEE43. The lighting package according to EEE41, wherein the light sources comprise OLEDs.

EEE44. The lighting package according to EEE39, wherein the lighting package is configured to be adjoined with other similar lighting packages in a display.

EEE45. The LED package according to EEE8, wherein at least two of the LED dies which differ in color temperature fall into the same category of primary color such as Red, Green, Blue.

EEE46. The LED package according to EEE8, wherein at least two of the LED dies which differ in color temperature differ within a same color range.

The invention claimed is:

1. An LED package comprising at least one LED die, the at least one LED die being configured to be electrically connected to a controller and to be driven to emit light in response to a driving signal from the controller, wherein the at least one LED die is further configured to detect at least one physical quantity, and transmit a feedback signal representative of the at least one physical quantity to the controller to adjust the driving signal based on the feedback signal, wherein the controller is integrated in the LED package, wherein the LED package comprises two or more LED dies which differ in color temperature, wherein at least two of the LED dies which differ in color temperature fall into the same category of primary color such as Red, Green, or Blue, and wherein the physical quantity comprises operating temperature of the at least one LED die, and the feedback signal comprises a representation of the operating temperature.

2. An LED package comprising at least one LED die, the at least one LED die being configured to be electrically connected to a controller and to be driven to emit light in response to a driving signal from the controller, wherein the at least one LED die is further configured to detect at least one physical quantity, and transmit a feedback signal representative of the at least one physical quantity to the controller to adjust the driving signal based on the feedback signal, wherein the controller is integrated in the LED package, wherein the LED package comprises two or more LED dies which differ in color temperature, wherein at least two of the LED dies which differ in color temperature fall into the same category of primary color such as Red, Green, or Blue, and wherein the physical quantity comprises at least a portion of light emitted by at least one other die in the LED package, and the feedback signal comprises a representation of an intensity of the detected light.

3. The LED package of claim 2, wherein the at least one LED die comprises:

a diode, the diode being a light-emitting diode for emitting light and a sensing diode for detecting the physical quantity;

a measuring circuit configured to receive and measure a current induced by the diode in response to the detected physical quantity and transmit the measured quantity as the feedback signal to the controller; and a driving circuit configured to provide to the diode a driving current in response to the driving signal.

4. The LED package of claim 2, wherein the at least one LED die comprises:

a diode, the diode being a light-emitting diode in a light-emitting mode or a sensing diode in a detecting mode for detecting the physical quantity;

a measuring circuit configured to receive and measure a current induced by the diode in response to the detected physical quantity and transmit the measured quantity as the feedback signal to the controller;

a driving circuit configured to provide to the diode a driving current in response to the driving signal; and a switch configured to selectively connect the diode to the measuring circuit in the detecting mode or to the driving circuit in the light-emitting mode based on a switch control signal from the controller.

5. The LED package of claim 2, wherein the LED package comprises at least a first LED die emitting red light, a second LED die emitting green light, and a third LED die emitting blue light.

6. The LED package of claim 2, wherein the LED package comprises two or more LED dies which emit essentially a same color.

7. The LED package of claim 6, wherein the same color is white color.

8. An LED package according to claim 2, the LED package further comprising a light diffusion layer disposed in front of the at least one LED die for uniformly distributing the emitted light, wherein the light diffusion layer comprises a plurality of dot elements arranged in a pattern that has a maximum dot density adjacent a central area of the pattern with the density gradually decreasing as a function of distance from the central area, the central area of the pattern being axially aligned with the at least one LED die.

9. An LED package comprising at least one LED die, the at least one LED die being configured to be electrically connected to a controller and to be driven to emit light in response to a driving signal from the controller, wherein the at least one LED die is further configured to detect at least one physical quantity, and transmit a feedback signal representative of the at least one physical quantity to the controller to adjust the driving signal based on the feedback signal, wherein the controller is integrated in the LED package, wherein the LED package comprises two or more LED dies which differ in color temperature, wherein at least two of the LED dies which differ in color temperature fall into the same category of primary color such as Red, Green, or Blue, and wherein the physical quantity comprises at least a portion of light emitted by at least one other die in the LED package, and the feedback signal comprises a representation of a color temperature of the detected light.

10. A backlight unit comprising a light source having a plurality of LED packages arranged in a two-dimension matrix form;

wherein the LED packages comprise comprising at least one LED die, the at least one LED die being configured to be electrically connected to a controller and to be driven to emit light in response to a driving signal from the controller, wherein the at least one LED die is further configured to detect at least one physical quantity, and transmit a feedback signal representative of the at least one physical quantity to the controller to adjust the driving signal based on the feedback signal, wherein the controller is integrated in the LED package, the LED package further comprising a light diffusion layer disposed in front of the at least one LED die for uniformly distributing the emitted light, wherein the light diffusion layer comprises a plurality of dot elements arranged in a pattern that has a maximum dot density adjacent a central area of the pattern with the density gradually decreasing as a function of distance from the central area, the central area of the pattern being axially aligned with the at least one LED die;

wherein the light diffusion layer comprises a plurality of diffusion modules arranged laterally, each having at least one optical connector disposed on the periphery for optically coupling the diffusion module to at least one other diffusion module; and wherein the light diffusion layer comprises a plurality of diffusion modules arranged laterally, each having at least one optical connector disposed on the periphery for optically coupling the diffusion module to at least one other diffusion module.

11. A backlight unit, comprising a light source having a plurality of LED packages arranged in a two-dimension matrix form;

wherein the LED packages comprise comprising at least one LED die, the at least one LED die being configured to be electrically connected to a controller and to be driven to emit light in response to a driving signal from the controller, wherein the at least one LED die is further configured to detect at least one physical quantity, and transmit a feedback signal representative of the at least one physical quantity to the controller to adjust the driving signal based on the feedback signal, wherein the controller is integrated in the LED package, the LED package further comprising a light diffusion layer disposed in front of the at least one LED die for uniformly distributing the emitted light, wherein the light diffusion layer comprises a plurality of dot elements arranged in a pattern that has a maximum dot density adjacent a central area of the pattern with the density gradually decreasing as a function of distance from the central area, the central area of the pattern being axially aligned with the at least one LED die;

wherein the light diffusion layer comprises a plurality of diffusion modules arranged laterally, each having at least one optical connector disposed on the periphery for optically coupling the diffusion module to at least one other diffusion module; and wherein the optical connector has an interlocking structure comprising at least a tongue and a groove.

12. A lighting package, comprising:

multiple light sources comprising at least two different color temperatures;

a controller configured to drive the light sources in a manner that produces an output light of a desired color temperature;

wherein the at least two different color temperatures vary in color temperature by an amount that allows production of the output light of the desired temperature to minimize and compensate the effect of color temperature shifts, wherein the at least two different color temperatures fall into the same category of primary color such as Red, Green, or Blue, and wherein the effect of color temperature shifts results from aging of the light sources.

13. The lighting package according to claim 12, wherein the lighting package is configured to be adjoined with other similar lighting packages in a display.

14. A package comprising:

multiple light sources comprising at least two different color temperatures;

a controller configured to drive the light sources in a manner that produces an output light of a desired color temperature;

wherein the at least two different color temperatures vary in color temperature by an amount that allows production of the output light of the desired temperature to minimize and compensate the effect of color temperature shifts, wherein the at least two different color temperatures fall into the same category of primary color such as Red, Green, or Blue, and wherein the lighting package further comprising a detector connected to the controller, wherein the controller is further configured to adjust the light sources in a manner that maintains the desired color temperature of the output light through aging and/or other changes of the light sources.

15. The lighting package according to claim 14, wherein the light sources comprise LEDs.

16. A lighting package, comprising:

multiple light sources comprising at least two different color temperatures;

a controller configured to drive the light sources in a manner that produces an output light of a desired color temperature;

wherein the at least two different color temperatures vary in color temperature by an amount that allows production of the output light of the desired temperature to minimize and compensate the effect of color temperature shifts, wherein the at least two different color temperatures fall into the same category of primary color such as Red, Green, or Blue, and wherein the light sources comprise OLEDs.

* * * * *